US009944069B2

(12) United States Patent
Hatakeyama

(10) Patent No.: US 9,944,069 B2
(45) Date of Patent: Apr. 17, 2018

(54) CONTROL SYSTEM AND IMAGE FORMING SYSTEM

(71) Applicant: Brother Kogyo Kabushiki Kaisha, Nagoya-shi, Aichi-ken (JP)

(72) Inventor: Yuichi Hatakeyama, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/473,184

(22) Filed: Mar. 29, 2017

(65) Prior Publication Data

US 2017/0282543 A1 Oct. 5, 2017

(30) Foreign Application Priority Data

Mar. 31, 2016 (JP) ..... 2016-071777

(51) Int. Cl.
*B41J 2/045* (2006.01)

(52) U.S. Cl.
CPC ..... *B41J 2/04508* (2013.01); *B41J 2/04586* (2013.01)

(58) Field of Classification Search
None
See application file for complete search history.

(56) References Cited

U.S. PATENT DOCUMENTS 5,164,931 A 11/1992 Yamaguchi et al.
2011/0310168 A1* 12/2011 Numata ..... B41J 2/16508 347/29

FOREIGN PATENT DOCUMENTS

JP H03-288913 A 12/1991
JP H11-110046 A 4/1999
JP 2013-051799 A 3/2013

* cited by examiner

*Primary Examiner* — Bradley Thies
(74) *Attorney, Agent, or Firm* — Banner & Witcoff, Ltd.

(57) ABSTRACT

There is provided a control system including: a motor, a moving apparatus, a detector, a driving circuit, and a controller. The controller executes: inputting, to the driving circuit, a first voltage command value up to a predetermined time; inputting, to the driving circuit, a second voltage command value since the predetermined time, and in accordance with a predetermined transfer function including an integral element; and setting an initial value of the integral element. The predetermined time is a time since the deceleration of the object has been started. When executing the switching from the first voltage command value to the second voltage command value, the controller sets a target position trajectory of the object up to the target stop position. Further, the controller sets the initial value of the integral element.

7 Claims, 9 Drawing Sheets

CONTROL SYSTEM AND IMAGE FORMING SYSTEM

CROSS REFERENCE TO RELATED APPLICATION

The present application claims priority from Japanese Patent Application No. 2016-071777 filed on Mar. 31, 2016 the disclosure of which is incorporated herein by reference in its entirety.

BACKGROUND

Field of the Invention

The present invention relates to a control system configured to control the movement of an object to be controlled (hereinafter referred to as "object" as appropriate) by controlling a motor.

Description of the Related Art

There is known a system configured to control the movement of an object by controlling input electric current or input voltage applied to a motor. In an image forming system such as an ink-jet printer, etc., the movement of a carriage having a recording head mounted thereon is controlled by controlling, for example, the input voltage to the motor.

There is also known a control system having a plurality of control modes. According to such a control system, for the purpose of suppressing any fluctuation in the torque caused by switching of the mode (mode switch), the initial value of an control input after the mode switch is set by using, for example, the control input immediately before the mode switch.

SUMMARY

There is also known a control system configured to switchably execute a velocity control and a position control so as to stop an object precisely at a target stop position. In this control system, in an initial phase of the control, the motor is controlled based on the deviation between the velocity of the object and a target velocity. At a later phase of the control in which the object approaches the target stop position, the motor is controlled based on the deviation between the position of the object and a target position.

The switching to the position control is executed, for example, while the object is decelerating by the velocity control. However, in a method for executing the above-described switching during the deceleration of the object in such a manner that the control input is succeeded or passed over between the velocity control and the position control, it is difficult to decelerate the object sufficiently by the position control for a while after the switching. Therefore, according to the conventional technique, the object cannot be stopped precisely at the target stop position, which in turn causes a problem such that a phenomenon called overshoot, wherein the object is stopped at the downstream of the target stop position, easily occurs.

According to an aspect of the present disclosure, in a system configured to control the movement of an object by executing switching from the velocity control to the position control to thereby allow the object to be stopped at a target stop position, it is possible to provide a technique capable of stopping the object at the target stop position with high precision.

According to a first aspect of the present disclosure, there is provided a control system including:

a motor;

a moving apparatus driven by the motor and configured to move an object;

a detector configured to detect a parameter from which a position, a velocity and an acceleration of the object are specifiable;

a driving circuit configured to input a voltage corresponding to a voltage command value to the motor; and a controller configured to execute:

inputting, to the driving circuit, a first voltage command value corresponding to a deviation between a target velocity and the velocity of the object which is specified from the parameter detected by the detector, until a predetermined time during a process in which the object is moving to the target stop position;

after the predetermined time, switching from the inputting the first voltage command value to the driving circuit to inputting a second voltage command value to the driving circuit, the second voltage command value corresponding to a deviation between a target position and the position of the object which is specified from the parameter detected by the detector, and the second voltage command value being in accordance with a transfer function including an integral element;

setting a target position trajectory of the object up to the target stop position based on the parameter detected by the detector;

setting an initial value of the integral element based on an initial target velocity and an initial target acceleration of the object in accordance with the target position trajectory; and inputting the second voltage command value to the driving circuit, wherein the predetermined time is a time after a deceleration of the object to stop the object at the target stop position has been started.

Thus, according to the first aspect of the present disclosure, in the system configured to perform the motor control by executing the switching from the velocity control to the position control to thereby allow the object to be stopped at the target stop position, it is possible to appropriately set the initial value in the position control. By setting the initial value appropriately, it is possible to realize a highly precise position control along the target position trajectory. Thus, according to the control system according to the first aspect of the present disclosure, the object can be stopped at the target stop position with high precision.

The technique for setting the initial value of the integral element may be applied to an image forming system. Examples of the image forming system include a serial printer such as an ink-jet printer, etc.

For example, according to a second aspect of the present disclosure, there is provided an image forming system including:

a recording head;

a carriage on which the recording head is mounted;

a motor;

a conveyor driven by the motor and configured to convey the carriage;

a detector configured to detect a parameter from which a position, a velocity and an acceleration of the carriage are specifiable;

a driving circuit configured to input a voltage corresponding to a voltage command value to the motor; and a controller configured to execute:

inputting, to the driving circuit, a first voltage command value corresponding to a deviation between a target velocity and the velocity of the carriage which is specified from the parameter detected by the detector, until a predetermined time during a process in which the carriage is moving to the target stop position;

after the predetermined time, switching from the inputting the first voltage command value to the driving circuit to the inputting a second voltage command value to the driving circuit, the second voltage command value corresponding to a deviation between a target position and the position of the carriage which is specified from the parameter detected by the detector, and the second voltage command value being in accordance with a transfer function including an integral element;

setting a target position trajectory of the carriage up to the target stop position based on the parameter detected by the detector;

setting an initial value of the integral element based on an initial target velocity and an initial target acceleration of the carriage in accordance with the target position trajectory inputting the second voltage command value to the driving circuit wherein the predetermined time is a time after a deceleration of the carriage to stop the carriage at the target stop position has been started.

According to this image forming apparatus, it is possible to stop the carriage appropriately at the target stop position. Accordingly, for example, it is possible to suppress any collision of the carriage against a wall located at an end in a conveyance path. For example, it is not necessary to make a casing of the image forming system to be great for the purpose of suppressing such a collision. In a case that the carriage makes a reciprocating movement, for example, it is possible to suppress the degradation of the print quality which would be otherwise caused by any incorrect (imprecise) turning point in the reciprocating movement.

DESCRIPTION OF THE EMBODIMENTS

In the following, an explanation will be given about an exemplary embodiment of the present disclosure, with reference to the drawings.

Figure 1:
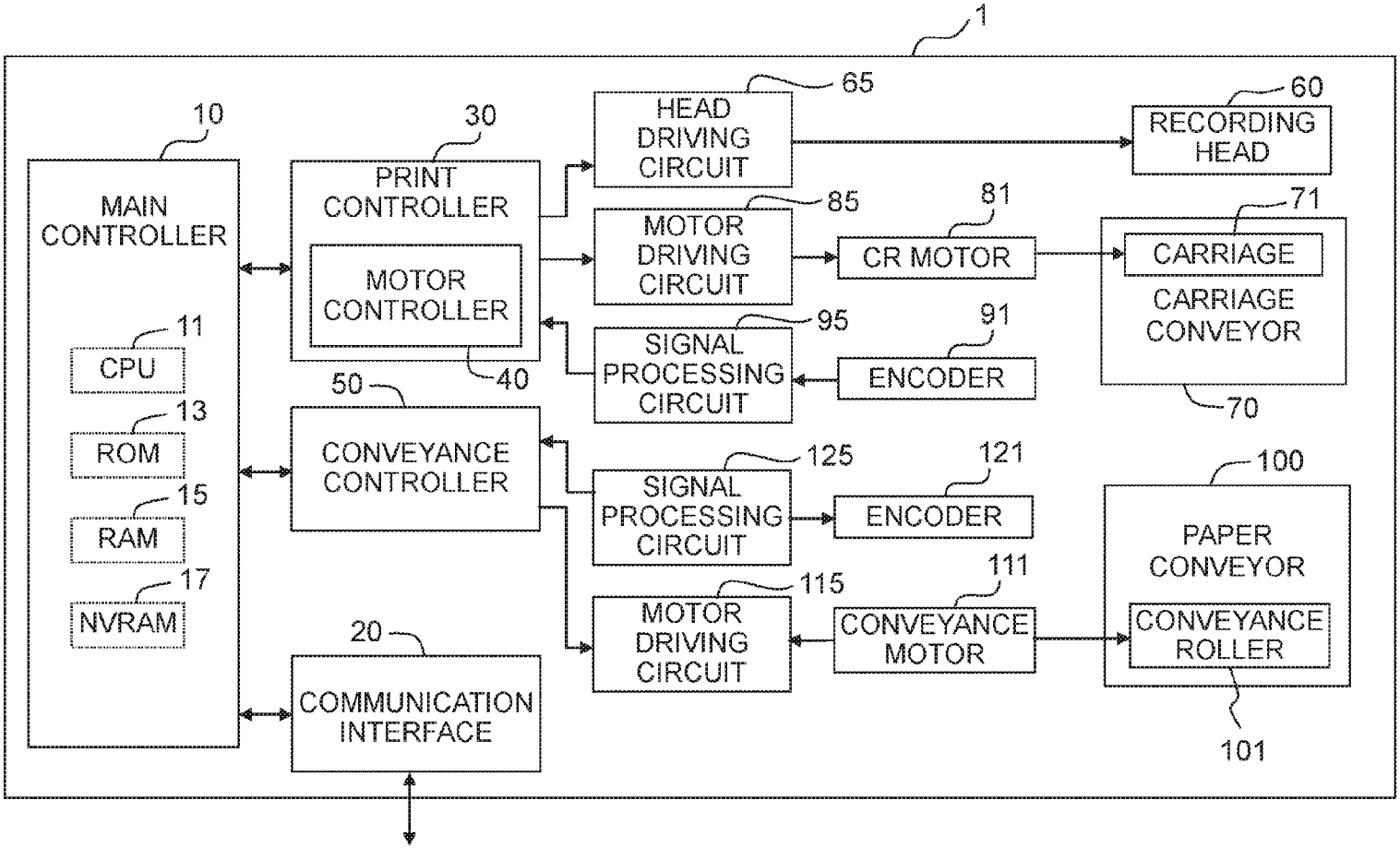
FIG. 1 is a block diagram depicting the configuration of an image forming system.

An image forming system 1 of the present embodiment as depicted in FIG. 1 is an ink-jet printer. The image forming system 1 is provided with a main controller 10, a communication interface 20, a print controller 30, and a conveyance controller 50.

The main controller 10 is provided with a CPU 11, a ROM 13, a RAM 15 and a NVRAM 17. The ROM 13 stores a program. The CPU 11 executes a processing in accordance with the program stored in the ROM 13 to thereby control respective sections, parts, components, etc., in the image forming system 1. The RAM 15 is used as a working area when the process is executed by the CPU 11. The NVRAM 17 is an electrically data rewritable memory, and is constructed as a flash memory or EEPROM. The NVRAM 17 stores a data which is required to be stored or retained even when the electricity is switched off.

The communication interface 20 is configured to be data-communicable with an external apparatus, and receives, for example, a print object data from the external apparatus. In accordance with an instruction from the main controller 10, the print controller 30 controls the conveyance of a carriage 71 having a recording head 60 mounted thereon, and further controls a liquid-droplet jetting operation by the recording head 60 for jetting a liquid droplet of an ink. With this, the print controller 30 controls an image forming operation with respect to a paper (paper sheet, or sheet) Q and thereby forms an image based on the print object data on the paper Q. According to an example of the present embodiment, an ASIC can be used as the print controller 30. Similarly, an ASIC can be used as the conveyance controller 50. The image forming system 1 is provided with the print controller 30, as the constituent component or element regarding the image forming operation. Further, the image forming system 1 is provided with the recording head 60, a head driving circuit 65, a carriage conveyor 70, a CR motor 81, a motor driving circuit 85, an encoder 91 and a signal processing circuit 95.

The recording head 60 is an ink-jet head configured to jet ink droplets toward the paper Q. The head driving circuit 65 drives the recording head 60 in accordance with an input signal from the print controller 30. The carriage conveyor 70 transmits the driving force from the CR motor 81 to the carriage 71 to thereby reciprocate the carriage 71 in a main scanning direction.

The CR motor 81 is a direct-current motor. The motor driving circuit 85 drives the CR motor 81 by the PWM control. Specifically, the motor driving circuit 85 inputs, to the CR motor 81, a driving voltage corresponding to a voltage command value U input from a motor controller 40 provided on the print controller 30. The voltage command value U input from the motor controller 40 to the motor driving circuit 85 indicates (represents) a driving voltage to be input to the CR motor 81.

The print controller 30 serves to realize the jetting control function for the ink droplet and the conveyance control function for the carriage 71. The motor controller 40 serves to realize the conveyance control function for the carriage 71. By the driving voltage control by the motor controller 40, the rotating operation of the CR motor 81 is controlled, thereby controlling the conveyance of the carriage 71.

The encoder 91 is a linear encoder configured to output an encoder signal in response to the displacement of the carriage 71 in the main scanning direction. The signal processing circuit 95 detects a position X in the main scanning direction of the carriage 71 and a velocity V of the carriage 71, based on the encoder signal input from the encoder 91. Further, the signal processing circuit 95 detects acceleration A of the carriage 71, as a differential value of the velocity V. The position X, the velocity V and the acceleration A of the carriage 71 detected by the signal processing circuit 95 are input to the print controller 30. The motor controller 40 of the print controller 30 controls the CR motor 81 based on the position X, the velocity V and the acceleration A of the carriage 71 input from the signal processing circuit 95.

The conveyance controller 50 controls the conveyance of the paper Q by controlling a conveyance motor 111 in accordance with an instruction from the main controller 10. The image forming system 1 is provided with, as the constituent components or elements regarding the conveyance of the paper Q, a paper conveyor 100, the conveyance motor 111, a motor driving circuit 115, an encoder 121 and a signal processing circuit 125.

The paper conveyor 100 receives the driving force from the conveyance motor 111 to rotate a conveyance roller 101 to thereby convey the paper Q in a sub scanning direction orthogonal to the main scanning direction. With this, the paper Q is supplied to an ink droplet-jetting position at which the ink droplets are jetted by the recording head 60. The conveyance motor 111 is a DC motor. The motor driving circuit 115 drives the conveyance motor 111 based on a control input from the conveyance controller 50. The control input is, for example, a current command value.

The encoder 121 is a rotary encoder arranged in the vicinity of the rotary shaft of the conveyance motor 111 or the conveyance roller 101 and configured to output an encoder signal corresponding to the rotation of the conveyance motor 111 or the conveyance roller 101. The signal processing circuit 125 detects the rotational position and the speed of rotation of the conveyance roller 101, based on the encoder signal input from the encoder 121.

The rotational position and the speed of rotation detected by the signal processing circuit 125 are input to the conveyance controller 50. The conveyance controller 50 determines the control input with respect to the conveyance motor 111 based on the rotational position and the speed of rotation detected by the signal processing circuit 125. With this, the conveyance of the paper Q by the rotation of the conveyance roller 101 is controlled.

Figure 2:
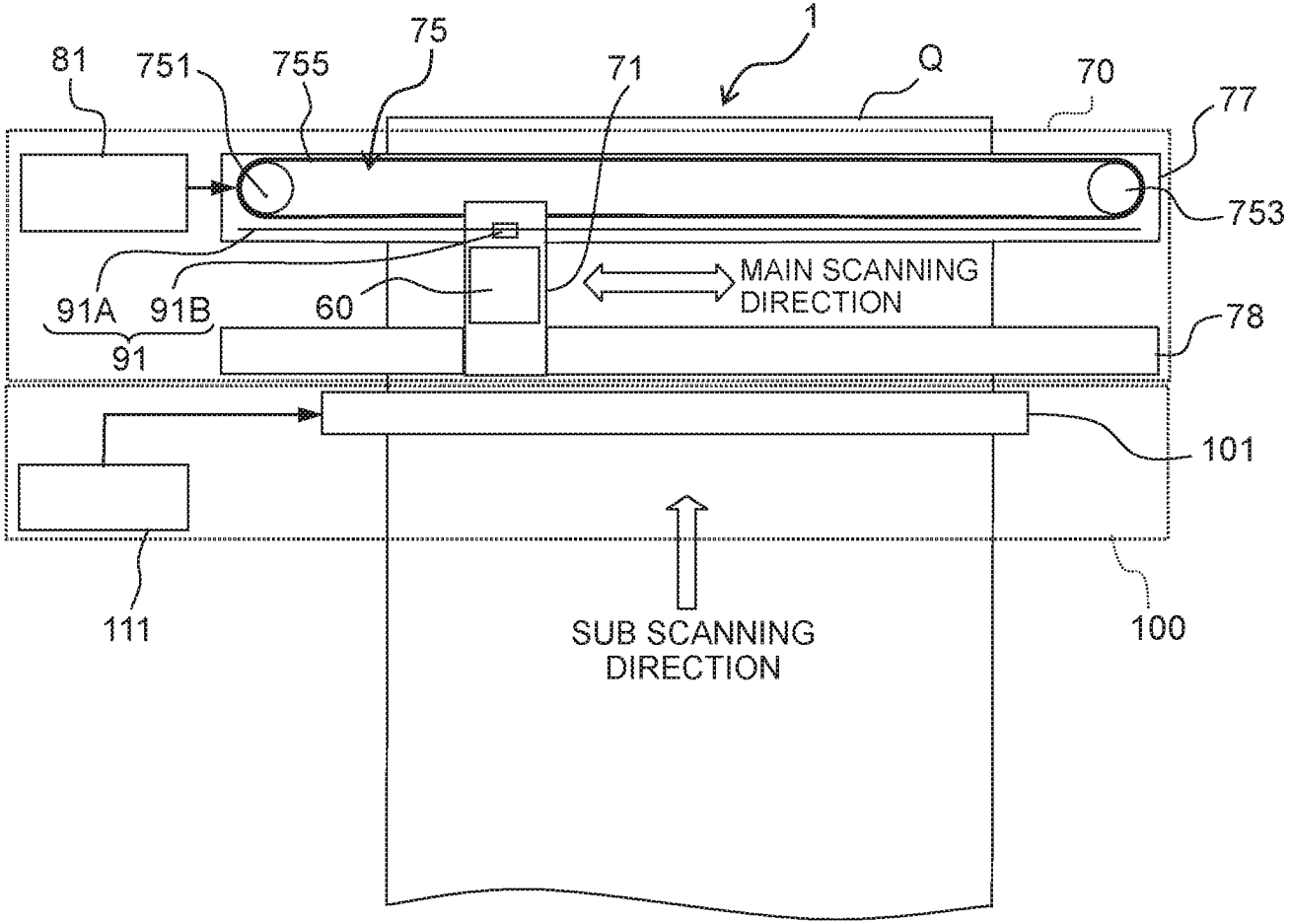
FIG. 2 is a top view depicting the mechanical configuration of a carriage conveyor.

Next, an explanation will be given about the configuration of the carriage conveyor 70. The carriage conveyor 70 is provided with the carriage 71, a belt mechanism 75, and guide rails 77 and 78, as depicted in FIG. 2.

The belt mechanism 75 is provided with a driving pulley 751 and a driven pulley 753 which are arranged in the main scanning direction, a belt 755 wound between the driving pulley 751 and the driven pulley 753. The carriage 71 is fixed to the belt 755. In the belt mechanism 75, the driving pulley 751 is rotated by receiving the driving force from the CR motor 81, and the belt 755 and the driven pulley 753 follow and rotate accompanying the rotation of the driving pulley 751.

The guide rails 77 and 78 are provided to extend along the main scanning direction, and are arranged at positions separated from each other in the sub scanning direction. The belt mechanism 75 is arranged in the guide rail 77. For example, the guide rails 77 and 78 are provided, respectively, with walls (not depicted in the drawings) extending in the main scanning direction such that the walls are projected from the guide rails 77 and 78. These walls regulate the movement of the carriage 71 such that a moving direction in which the carriage 71 moves becomes the main scanning direction. For example, the carriage 71 is placed on the guide rails 77 and 78 such that the walls are arranged in grooves formed in the lower surface of the carriage 71, respectively. In this state, the carriage 71 reciprocates on the guide rails 77 and 87 in the main scanning direction, while being linked to the rotation of the belt 755. The recording head 60 is mounted on the carriage 71 and moves in the main scanning direction accompanying with the movement (reciprocating movement) of the carriage 71.

The conveyance roller 101 is arranged on the upstream of the recording head 60 in the sub scanning direction. The conveyance roller 101 is rotated in such a manner that the conveyance roller 101 feeds the paper Q, which is being conveyed from the upstream side thereof, to the ink droplet-jetting position at which the ink droplets are jetted by the recording head 60. The paper conveyor 100 is provided with a non-illustrated paper feed roller which is arranged on the upstream of the conveyance roller 101 in the sub scanning direction and which is configured to pick up the paper Q, from a tray, and to convey the paper Q toward the downstream in the sub scanning direction.

The above-described encoder 91 is provided with an encoder scale 91A and an optical sensor 91B, as depicted in FIG. 2. The encode scale 91A is arranged in the guide rail 77 along the main scanning direction. The optical sensor 91B is mounted on the carriage 71. The encoder 91 inputs, to the signal processing circuit 95, an encoder signal in response to the change in the relative position of the optical sensor 91B with respect to the encoder scale 91A. The encode signal is a pulse signal in which a pulse edge is generated every time the optical sensor 91B is moved by a predetermined amount with respect to the encoder scale 91A. The encoder signal includes an A-phase signal and a B-phase signal.

The signal processing circuit 95 detects the position X and the velocity V of the carriage 71 based on the encoder signal. For example, the signal processing circuit 95 is provided with an edge detecting section 951, a position detector 953, a velocity detector 955, and a differentiator 957. The edge detecting section 951 detects a pulse edge included in the input signal from the encoder 91, and inputs an edge detection signal based on the detected pulse edges to the position detector 953 and the velocity detector 955.

The position detector 955 counts the pulse edges of the encoder signal based on the edge detection signal, and to thereby detect the position X of the carriage 71. The velocity detector 955 measures a time interval between adjacent pulse edges among the pulse edges to thereby detect the velocity V of the carriage 71. The velocity V corresponds to the inverse number of the time interval between the adjacent pulse edges.

The differentiator 957 calculates the differential value of the velocity V detected by the velocity detector 555, namely, the amount of change, per unit time, of the velocity V, to thereby detect the acceleration A of the carriage 71.

Figure 3:
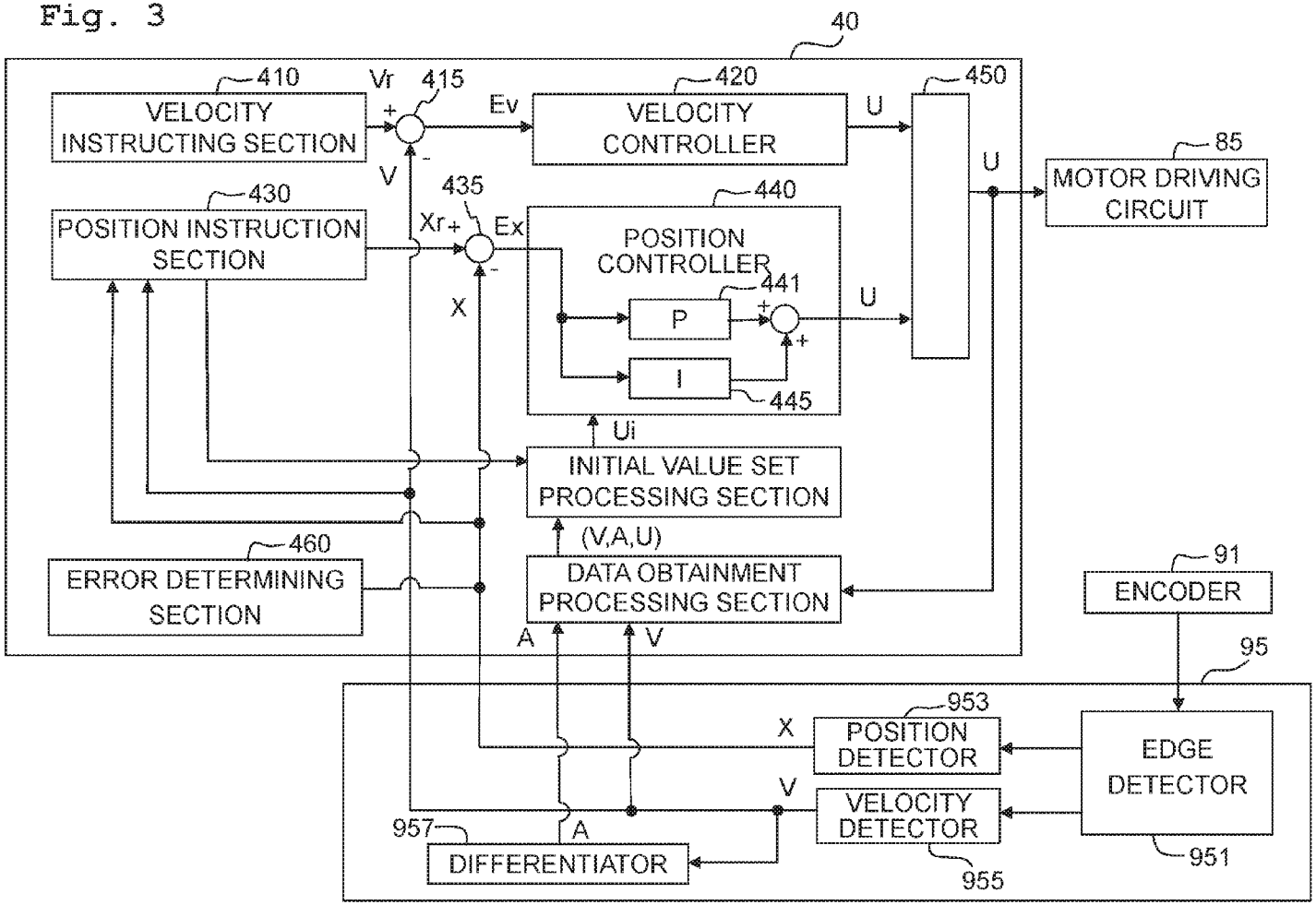
FIG. 3 is a block diagram depicting the configurations of a motor controlling section and a signal processing circuit.
Figure 4:
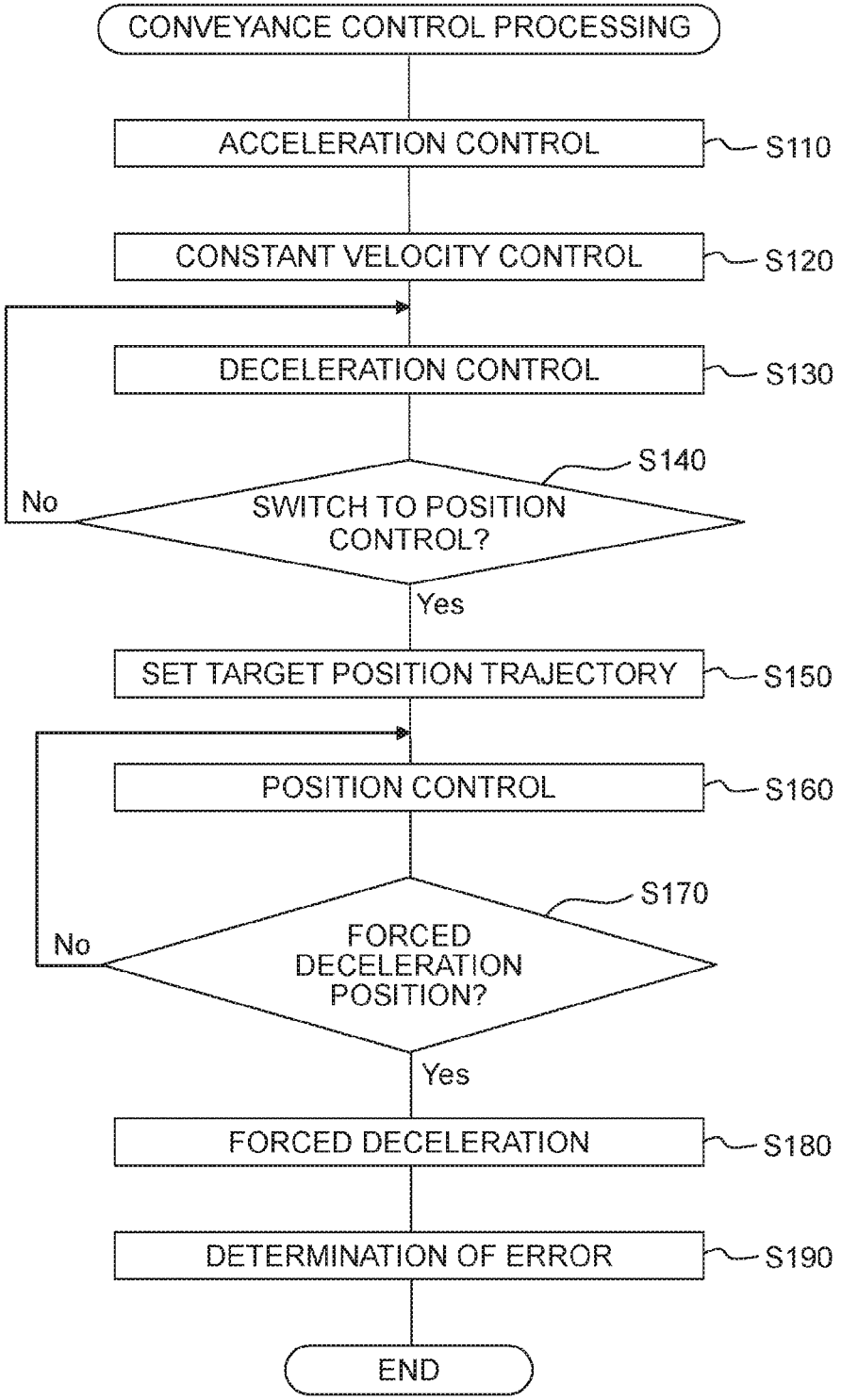
FIG. 4 is a flowchart depicting a conveyance control processing executed by the motor controlling section.

In a case that a conveyance instruction for conveying the carriage 71 is input from the main controller 10 to the motor controller 40, the motor control unit 40 executes a conveyance control processing as depicted in FIG. 4, in accordance with the input conveyance instruction. This conveyance control processing is realized by a velocity instructing section 410, a velocity deviation calculating section 415, a velocity controller 420, a position instructing section 430, a positional deviation calculating section 435, a position controller 440, a switching device 450 and an error determining section 460 as depicted in FIG. 3 and provided on the motor controller 40. In addition to the above-described sections and devices, the motor controller 40 is provided with a data obtainment processing section 470 and an initial value set processing section 480.

Figure 5:
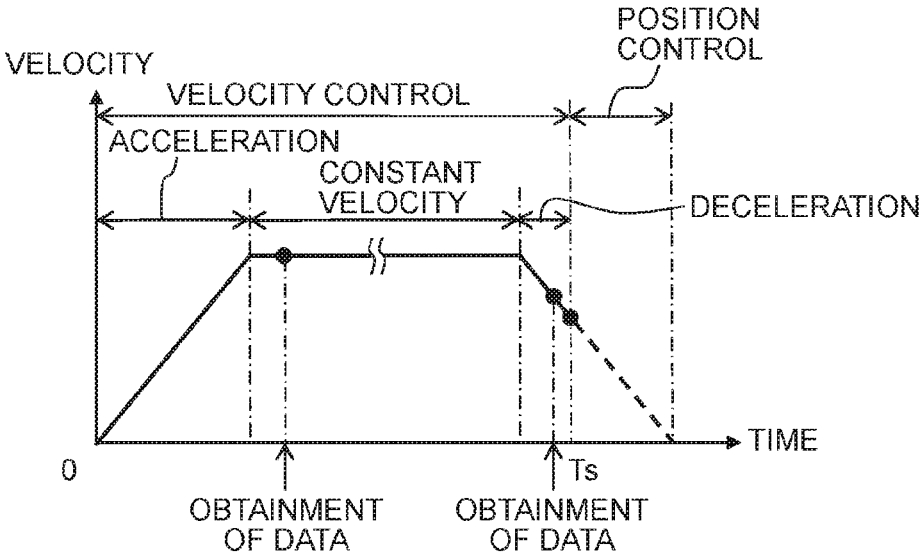
FIG. 5 is a graph depicting an example of a target velocity trajectory.

In a case that the motor controller 40 starts the conveyance control processing, the motor controller 40 executes a velocity control, of the carriage 71, including an acceleration control, a constant velocity control and a deceleration control, in this order and based on a target velocity trajectory in accordance with the above-described conveyance instruction (steps S110 to S130). The target velocity trajectory represents the trajectory of a target velocity "Vr" with respect to each of respective times "t" from a control start time t=0, and includes an acceleration segment, a constant velocity segment and a deceleration segment, as depicted in FIG. 5.

In a case that the conveyance instruction is input to the velocity instruction section 410, the velocity instructing section 410 inputs, to the velocity deviation calculating section 415, target velocities "Vr" of the respective times "t" in accordance with the target velocity trajectory up to a switch time t=Ts which corresponds to the terminal end of the target velocity trajectory and at which switching to a position control is executed. The velocity deviation calculating section 415 calculates a deviation Ev=Vr−V between the target velocity V input from the velocity instructing section 410 and the velocity V detected by the signal processing circuit 95, and inputs the calculated deviation Ev to the velocity controller 420.

The velocity controller 420 inputs, to the switching device 450, a voltage command value U for causing the velocity V of the carriage 71 to follow the target velocity trajectory, as the voltage command value U corresponding to the deviation Ev input from the velocity deviation calculating section 415. As the velocity controller 420, it is possible to use, for example, a PID controller.

The switching device 450 inputs the voltage command value U input from the velocity controller 420 to the motor driving circuit 85 until the switch time Ts to the position control arrives. When the switch time Ts arrives, the switching device 450 inputs a voltage command value U input from the position controller 440 to the motor driving circuit 85.

Such a feedback control according to the target velocity trajectory including the acceleration segment, the constant velocity segment and the deceleration segment as described above is executed through the velocity controller 420. With this, the velocity control of the carriage 71 including the acceleration control, the constant velocity control and the deceleration control (steps S110 to S130) are realized.

As depicted in FIG. 4, the motor controller 40 executes the deceleration control (S130) until the arrival of the switch time Ts to the position control; when the switch time Ts to the position control arrives (S140: YES), the motor controller 40 sets a target position trajectory based on a position X=Xs and a velocity V=Vs of the carriage 71, at the time of the switching to the position control, which are detected by the signal processing circuit 95 and corresponding to an actual position X and an actual velocity V of the carriage 71 (S150).

Specifically, the motor controller 40 sets such a target position trajectory that an initial target velocity Vr (t=Ts) coincides with the velocity Vs at the time of switching and then the carriage 71 decelerates and stops at a target stop position Xe, based on a distance D=|Xe−Xs| which is specified from the error between the position Xs of the carriage 71 at the time of the switching and the target stop position Xe, and based on the velocity Vs at the time of the switching (S150).

For example, in the position control, it is conceived that the carriage 71 is decelerated from the velocity Vs at a constant deceleration and is made to stop at the target stop position Xe. A target velocity trajectory Vr(t) for realizing such a control can be expressed by the following expression.

$$Vr(t)=Vs-\{Vs^2/(2\times D)\}(t-Ts)$$

Note that, however, regarding the velocities "Vr(t)" and "Vs" in the expression, the velocities each take a positive value with respect to the advancing direction in which the carriage 71 moves from the position Xs at the time of the switching toward the target stop position Xe. The above expression represents the target velocity trajectory Vr(t) up to an arrival time "t=Ts+2×|D|/Vs" from the switch time "t=Ts". The target velocity trajectory Vr(t) since the time "t=Ts+2×|D|/Vs" is Vr(t)=0 (zero).

The target position trajectory Xr(t) can be set to a time derivative (time integral) Xr of the above-described target velocity trajectory Vr(t) that is: $Xr(t)=Xs+\{(Xe-Xs)/|Xe-Xs|\}\times\int Vr(t)dt$.

Figure 6:
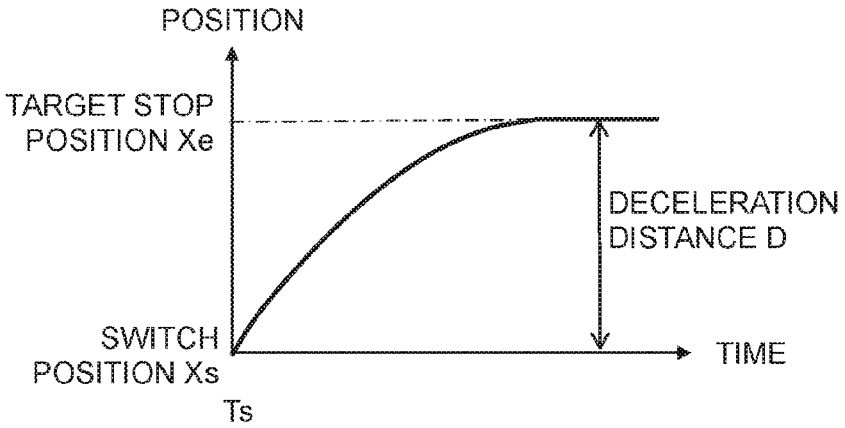
FIG. 6 is a graph depicting an example of a target position trajectory.

The outline of the target position trajectory Xr(t) is as depicted in FIG. 6. According to the target position trajectory Xr(t), the initial target velocity as the target velocity at the start of the position control is the actual velocity Vs at the time of switching, and the initial target velocity is $Ar=-\{Vs^2/(2\times D)\}$. According to the above example, the target position trajectory at the time of the position control takes the quadratic function. It is allowable, however that the target position trajectory at the time of the position control is defined by using a function different from the quadratic function, for example, a sine function.

In a case that the target position trajectory is set in step S150, an initial value "Ui" is set, by the initial value set processing section 480, in an integrator 445 possessed by the position controller 440 (to be explained in detail later on). According to an example depicted in FIG. 3, the position controller 440 is constructed as a PI controller, includes a proportional device 441 and the integrator 445, and outputs, as the voltage command value U, the total value of an output of the proportioning device 441 and an output of the integrator 445 corresponding to the deviation Ex.

After the initial value is set, the motor controller 40 executes step S160, and repeatedly executes the position control processing according to the target position trajectory set in step S150 until the carriage 71 arrives at a forced deceleration position Xd which is in front of the target stop position Xe by a predetermined distance (steps S160, S170). The forced deceleration position Xd is a position at which the driving of the CR motor 81 by the motor driving circuit 85 is stopped and the CR motor is subjected to forced deceleration. The forced deceleration position Xd may be a position at which a short circuit braking with respect to the CR motor 81 is started.

In a case that the conveyance control of the carriage 71 is switched to the position control, the position instruction section 430 inputs, to the positional deviation calculating section 435, a target position Xr at each of the respective times t, in accordance with the target position trajectory set as described above. The positional deviation calculating section 435 calculates the deviation Ex=Xr−X of the target position Xr input from the position instructing section 430 and the position X of the carriage 71 detected by the signal processing circuit 95, and the positional deviation calculating section 435 inputs the calculated deviation Ex to the position controller 440.

The position controller 440 inputs, to the switching device 450, a voltage command value U for causing the position X of the carriage 71 to follow the target position trajectory, as a voltage command value U corresponding to the deviation Ex input from the positional deviation calculating section 435. In a case that the switch time Ts to the position control arrives, the switching device 450 inputs the voltage command value U input from the position controller 440 to the motor driving circuit 85, as described above. The feedback control according to the target position trajectory is executed through the position controller 440. With this, the position control of the carriage 71 is realized, thereby conveying the carriage 71 to the target stop position Xe.

In a case that the carriage 71 arrives at the forced deceleration position Xd (S170: YES), then the motor controller 40 executes a processing for forcibly decelerating the CR motor 81 (step S180). Specifically, the motor controller 40 may input, to the motor driving circuit 85, a voltage command value U=0 (zero), instead of the voltage command value U from the position controller 440. Alternatively, the motor controller 40 may control the switch of an H bridge possessed by the motor driving circuit 85 so as to short circuit the CR motor 81, thereby making it possible to decelerate and stop the CR motor 81. The processing regarding step S180 can be executed by the switching device 450.

By such a processing, the CR motor 81 is stopped, and the carriage 71 is stopped. The forced deceleration position Xe is set at a location in front of the target stop position Xe, by a distance in which the carriage 71 is presumed to move from the execution of the processing in step S180 until the carriage 71 is stopped. Through the processing in step S180, the carriage 71 is operated to stop at the target stop position Xe.

Afterwards, the motor controller 40 executes an error determination processing, and ends the conveyance control processing depicted in FIG. 4 (step S190). In the error determination processing, the error determining section 460 determines as to whether or not error δ between the actual stop position X and the target stop position Xe of the carriage 71, as a conveyance error δ, is great. The error determining section 460 determines that the conveyance error δ is great, under a condition that the error δ between the position X, of the carriage 71, detected by the signal processing circuit 95 after the carriage 71 has been stopped and the target stop position Xe is greater than a predetermined threshold value TH. The result of determination of the conveyance error δ is temporarily stored by the error determining section 460.

Figure 7:
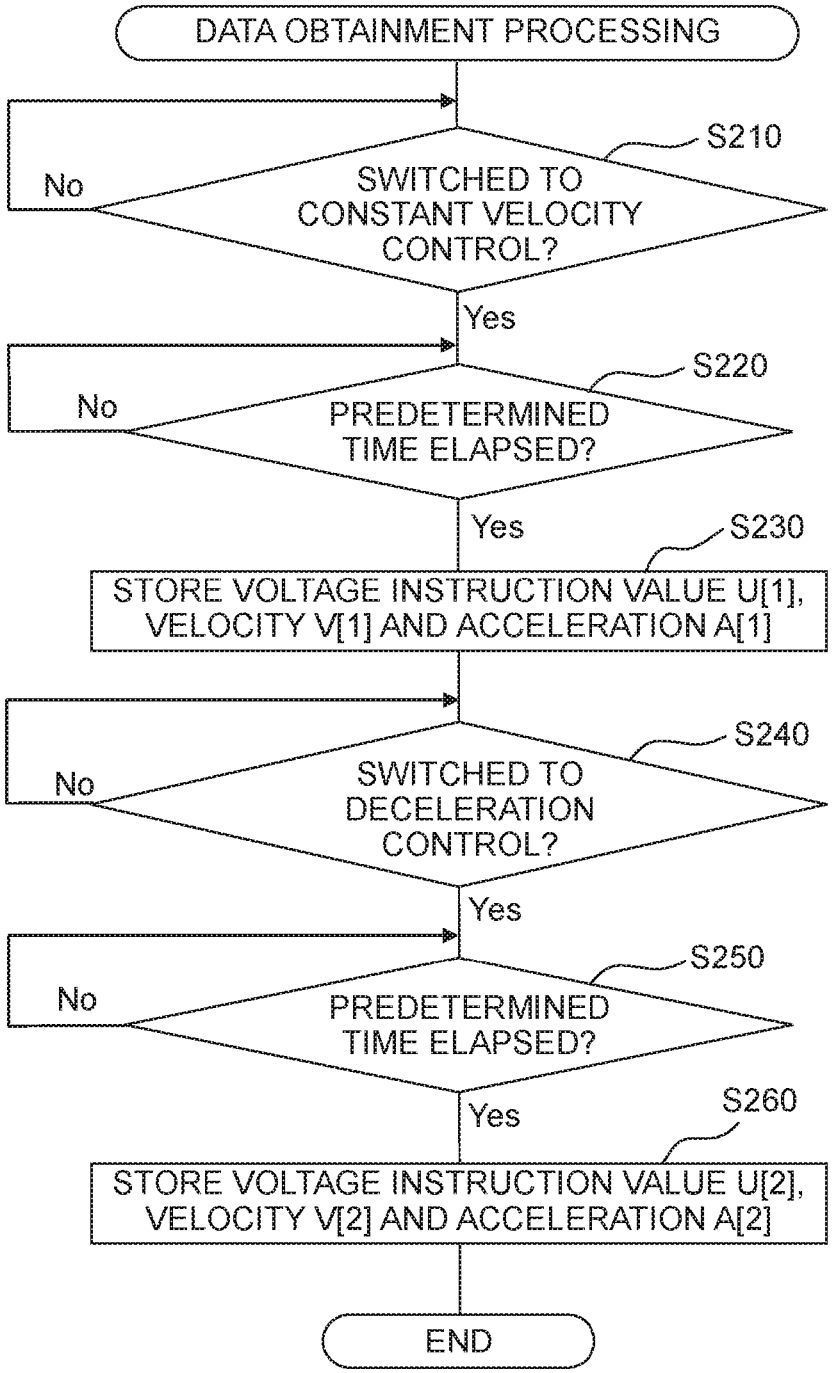
FIG. 7 is a flowchart depicting a data obtainment processing executed by the motor controlling section.

Next, a processing executed by the data obtainment processing section 470 of the motor controller 40 will be explained. The data obtainment processing section 470 starts the data obtainment processing depicted in FIG. 7 when the motor controller 40 starts the execution of the conveyance control processing by receiving the conveyance instruction from the main controller 10. In a case that the data obtainment processing section 470 starts the processing depicted in FIG. 7, the data obtainment processing section 470 stands by until the velocity control of the carriage 71 in accordance with the target velocity trajectory is switched from the acceleration control to the constant velocity control (S210).

In a case that the acceleration control is switched to the constant velocity control at a time of switching (S210: YES), the data obtainment processing section 470 stands by until a predetermined time elapsed since the time of switching (S220: YES); and the data obtainment processing section 470 stores, as a first obtained data, the velocity V and the acceleration A of the carriage 71 input from the signal processing circuit 95, together with a voltage command value U input from the motor controller 40 to the motor driving circuit 85 at that time (after the elapse of the predetermined time since the time of switching) (S230).

In the following, the velocity V and the acceleration A of the carriage 71 and the voltage command value U indicated by the first obtainment data are referred to respectively as a first obtainment value (V[1], A[1], U[1]) with suffixes [1] added thereto, respectively. The predetermined time as the elapsed time since the time of the switching from the acceleration control to the constant velocity control until the first obtainment data is stored is set to be, for example, a time longer than a time required for the control after the switching to be stabilized, and a time before a time of switching from the constant velocity control to the deceleration control.

In a case that the data obtainment processing section 470 stores the first obtained data, the data obtainment processing section 470 stands by until the velocity control of the carriage 71 is switched from the constant velocity control to the deceleration control (step S240). Then, the constant velocity control is switched to the deceleration control (S240: YES), then after standing until a predetermined time elapses since the time of the switching to the deceleration control (S250: YES), the data obtainment processing section 470 stores, as a second obtained data, the velocity V and the acceleration A of the carriage 71 input from the signal processing circuit 95, together with a voltage command value U input from the motor controller 40 to the motor driving circuit 85 at that point of time (after the elapse of the predetermined time since the time of switching) (Step S260).

In the following, the velocity V and the acceleration A of the carriage 71 and the voltage command value U indicated by the second obtainment data are referred to respectively as a second obtainment value (V[2], A[2], U[2]) with suffixes [2] added thereto, respectively. Then, the data obtainment processing section 470 ends the data obtainment processing.

Figure 8:
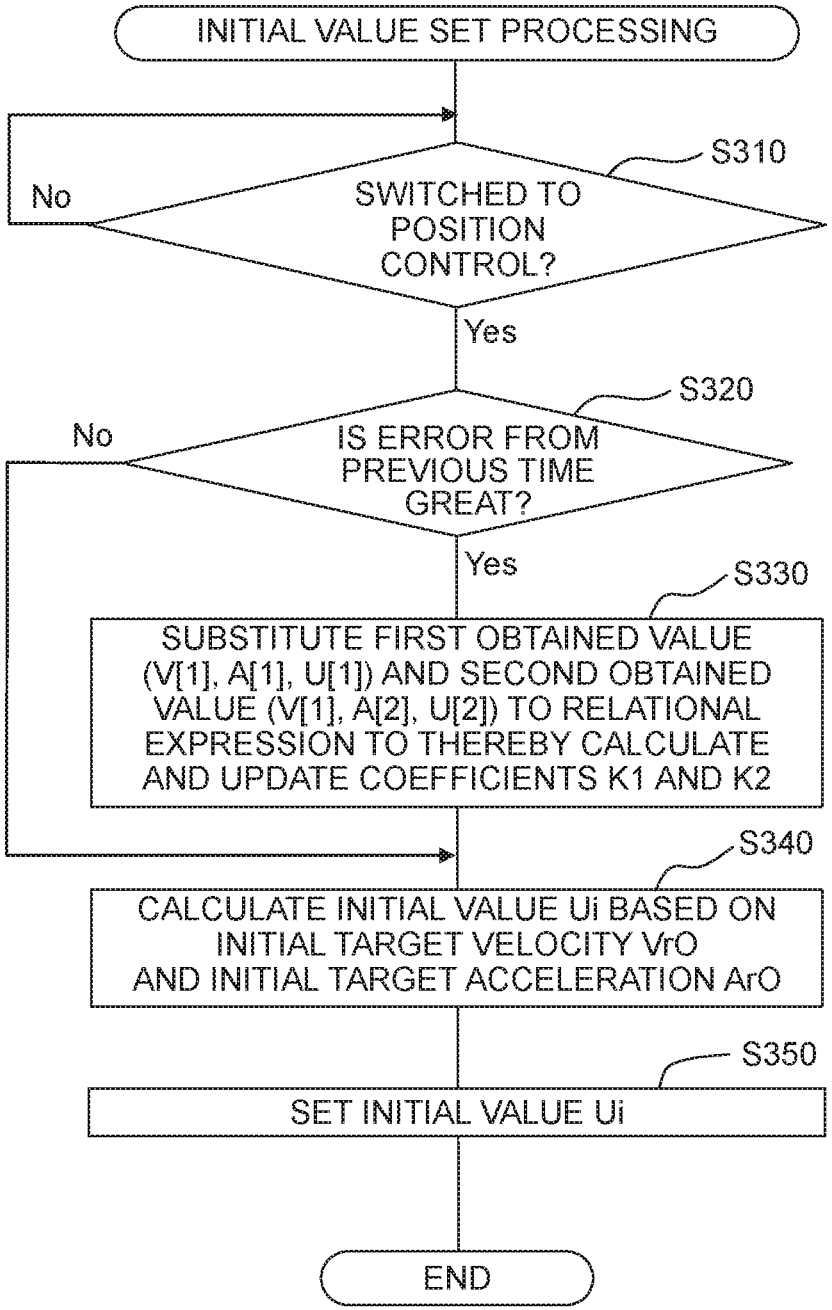
FIG. 8 is a flowchart depicting an initial value set processing executed by the motor controlling section.

Other than those described above, an explanation will be given about a processing executed by the initial value set processing section 480 of the motor controller 40. In a case that the conveyance instruction from the main controller 10 is received by the motor controller 40 and that the conveyance control processing is started by the motor controller 40, the initial value set processing section 480 starts an initial value set processing depicted in FIG. 8. In a case that the initial value set processing section 480 starts the processing depicted in FIG. 8, the initial value set processing section 480 stands by until the switch time Ts from the velocity control to the position control arrives (step S310).

In a case that the switch time Ts arrives (S310: YES), the initial value set processing section 480 executes a processing of step S330 under a condition that the conveyance error δ is determined to be great in the error determination processing executed the previous time (last time) (S320: YES). On the other hand, the initial value set processing section 480 skips the processing of step S330 and executes a processing of step S340, under a condition that the conveyance error δ has not been determined to be great in the error determination processing executed the previous time (S320: NO).

In step S330, the initial value set processing section 480 solves the following simultaneous equations obtained by substituting the first obtained value (V[1], A[1], U[1]) and the second obtained value (V[2], A[2], U[2]) stored by the data obtainment processing section 470 to a relational expression U=K1×V+K2×A, to thereby calculate coefficients K1 and K2. After that, the initial value set processing section 480 executes step S340.

$$U[1]=K1\times V[1]+K2\times A[1]$$

$$U[2]=K1\times V[2]+K2\times A[2]$$

The coefficients K1 and K2 can be calculated, specifically, in accordance with the following expressions.

$$\begin{pmatrix} K1 \\ K2 \end{pmatrix} = \begin{pmatrix} V[1] & A[1] \\ V[2] & A[2] \end{pmatrix}^{-1} \begin{pmatrix} U[1] \\ U[2] \end{pmatrix} \quad \text{[Expression 1]}$$

In step S340, initial value set processing section 480 calculates the initial value Ui to be set in the integrator 445 of the position controller 440 according to the following expression, based on the initial target velocity Vr0=Vr(t=Ts) according to the initial position trajectory set in step S150, and based on the initial target acceleration Ar0.

$$Ui=K1\times Vr0+K2\times Ar0$$

The initial value set processing section 480 sets the initial value Ui calculated as described above in the integrator 445 of the position controller 440 (step S350), and ends the initial value set processing.

Here, the calculation principal of the initial value Ui will be explained. Regarding an input voltage Ve to the CR motor 81, the following expression holds:

$$Ve=Rm\times Im+Ke\times Kv\times V$$

In the expression, "Rm" represents the resistance of an armature, "Im" represents a current flowing thorough the CR motor 81 with respect to the input voltage Ve, "Ke" represents the back electromotive force constant, and "Kv" represents the conversion coefficient from the velocity V of the carriage 71 to a motor angular velocity. The torque generated from the CR motor 81 is in proportion to the driving current Im of the CR motor 81. However, since the back electromotive force is generated in the CR motor 81 due to the rotation, any proportional relationship does not hold between the input voltage Ve input to the CR motor 81 and the current Im flowing through the CR motor 81.

On the other hand, regarding the motion equation of the carriage 71, the following expression holds:

$$J\times A=Kt\times Im-\mu\times V$$

in the expression, "J" represents the moment of inertia of the kinetic system of the carriage 71, "Kt" represents the torque constant, "μ" represents the viscous frictional coefficient, "V" represents the velocity of the carriage 71 and "A" represents the acceleration of the carriage 71.

Accordingly, regarding the input voltage Ve to the CR motor 81, the following expression holds:

$$Ve=\{(Rm/Kt)\times J\}\times A+\{(Rm/Kt)\times\mu+Ke\times Kv\}\times V$$

Here, provided that K1=(Rm/Kt)×μ+Ke×Kv; and that K2=(Rm/Kt)×J, then the above expression is Ve=K1×V+K2×A. This expression represents the relationship between the input voltage Ve, and the velocity V and the acceleration A of the carriage 71 realized by the input voltage Ve.

Accordingly, with respect to the initial target velocity Vr0 and the initial target acceleration Ar0, it is appropriate to input, to the motor driving circuit 85 immediately after the start of the position control, the voltage command value U in accordance with the relational expression Ui=K1×Vr0+K2×Ar0. From such a reason as described above, in step S340, the initial value Ui in accordance with the relational expression Ui=K1×Vr0+K2×Ar0 is set in the integrator 445 of the position controller 440.

As an additional remark, the reason for calculating the coefficients K1 and K2 in step S330 is that the coefficient K1 contains, as a component thereof, the viscous frictional coefficient μ which is easily changed due to consumption of grease, etc., and that the coefficient K2 includes, as a component thereof, the resistance of an armature Rm which is easily changed, for example, by the influence of temperature, etc.

In the present embodiment in a case that the conveyance error δ becomes great, the coefficients K1 and K2 are calculated and updated in step S330 to thereby correspond to the change related to the passage of time of the actual values of the coefficients K1 and K2. The updated coefficients K1 and K2 are stored and held in the initial value set processing section 480 or in the NVRAM 17. In a case that the coefficients K1 and K2 are not stored and held in the NVRAM 17, then the initial value set processing section 480 may be configured such that when the switching to the position control in the conveyance control is executed for the first time since the image forming system 1 is powered on, the initial value set processing section 480 executes an affirming determination for the sake of formality in step S320, and then executes the processing in step S330.

Figure 9A:
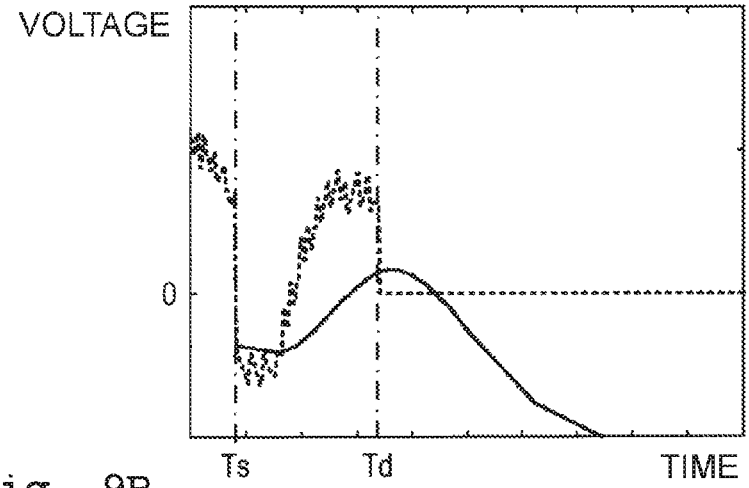
FIGS. 9A to 9C are graphs depicting examples of a voltage command value, a velocity of a carriage, and a position of the carriage, respectively, in the system of an embodiment.
Figure 9B:
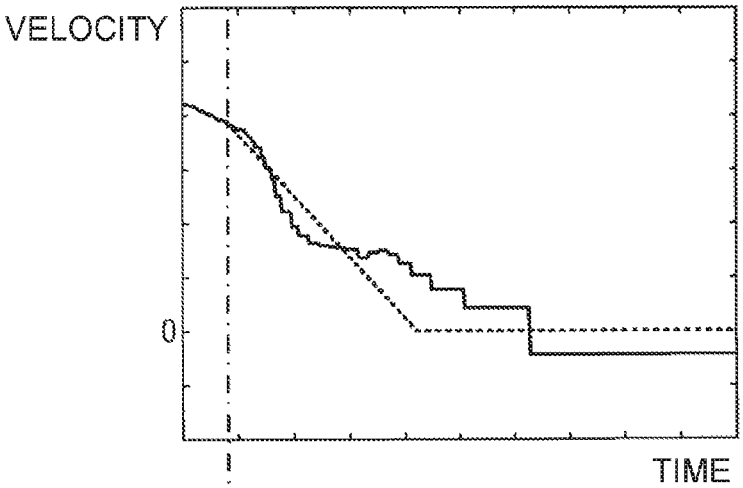
Figure 9C:
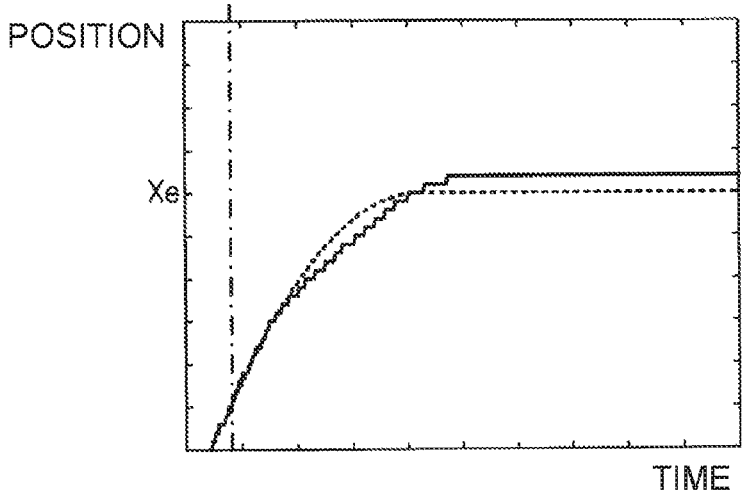

FIGS. 9A to 9C depict the outline of the result of the control in a case that the initial value Ui is set as described above, and FIGS. 10A and 10C depict, as a reference example, the outline of the result of the control in another case that the initial value Ui of the integrator 445 at the time of starting the position control is set to be the voltage command value U at the time at which the velocity control is ended.

A graph in FIG. 9A is a graph depicting the change with respect to time of the voltage command value U with respect to the CR motor 81, wherein the horizontal axis indicates the time and the vertical axis indicates the voltage, and the output of the integrator 445 is indicated by a solid line and the input to the motor driving circuit 85 is indicated by a broken line.

A graph in FIG. 9B is a graph depicting the change with respect to time of the velocity V of the carriage 71 in a case that the conveyance control is executed based on (by) the voltage command value U indicated in the graph of FIG. 9A, wherein the horizontal axis indicates the time and the vertical axis indicates the velocity, and the velocity of the carriage 71 detected by the signal processing circuit 95 is indicated by a solid line and the target velocity trajectory as the differential to the target position trajectory is indicated by a broken line.

A graph in FIG. 9C is a graph depicting the change with respect to time of the position Xe of the carriage 71 in a case that the conveyance of the carriage is executed corresponding to the voltage command value U indicated in the graph of FIG. 9A, wherein the horizontal axis indicates the time and the vertical axis indicates the position of the carriage 71, and the position of the carriage 71 detected by the signal processing circuit 95 is indicated by a solid line and the target position trajectory of the carriage 71 is indicated by a broken line.

The time axis is common in the graphs of FIGS. 9A to 9C, and the time Ts indicated in FIG. 9A corresponds to the switch time to the position control, the time Td indicated in FIG. 9A corresponds to a time of starting the forced deceleration control (step S180).

Figure 10A:
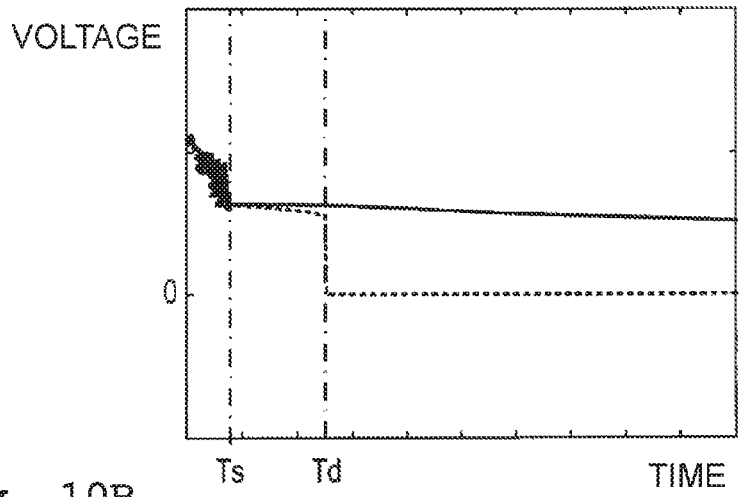
FIGS. 10A to 10C are graphs depicting examples of a voltage command value, a velocity of a carriage, and a position of the carriage, respectively, in the system of a reference example.
Figure 10B:
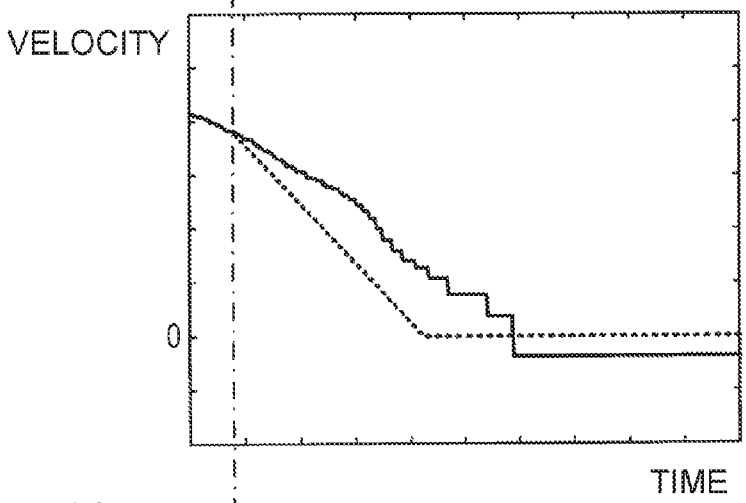
Figure 10C:
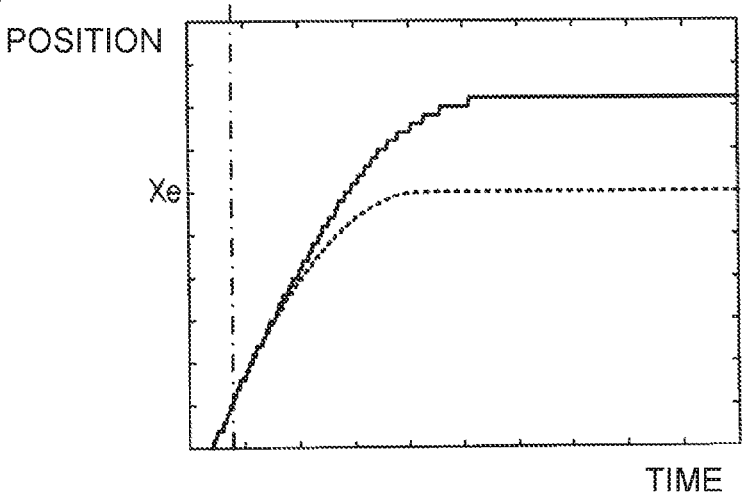

The vertical and horizontal axes and the solid and broken lines in the graphs of FIGS. 10A to 10C may be understood similarly to those in FIGS. 9A to 9C. In the result of the control indicated in FIGS. 10A to 10C, the target velocity trajectory and the target position trajectory are same as those in FIGS. 9A to 9C, whereas only the method for setting the initial value Ui in the integrator 445 is different from that in FIGS. 9A to 9C.

In the graphs of FIGS. 9B and 10B, the phenomenon that the velocity finally becomes constant at a negative value is caused merely by such a situation that the carriage 71 retreats slightly backward due to the backlash of the gear and stops, and then no encoder signal is output, which in turn causes that the negative value to appear continuously. Namely, it should be understood that the retreating of the carriage 71 is an instantaneous event and that the carriage 71 is stopped continuously after that.

As appreciated from the comparison between the graphs of FIGS. 9A to 9C to those of FIGS. 10A to 10C, the tracking property of the velocity V, immediately after the starting of the position control, with respect to the target velocity trajectory in the present embodiment is more satisfactory than the case of setting, in the integrator 445, the initial value Ui at the time of starting the position control processing, to be the voltage command value U at the time at which the velocity control is ended. As a result, according to the present embodiment, it is possible to stop the carriage 71 at the target stop position Xe with high precision, as appreciated from the graph of FIG. 9C.

As described above, according to the image forming system 1 of the embodiment, the motor controller 40 controls the CR motor 81 in accordance with the instruction from the main controller 10 such that the carriage 71, as the object to be conveyed, is moved to the target stop position Xe.

The motor controller 40 executes the velocity control processing (steps S110 to S140) of inputting, to the motor driving circuit 85, the voltage command value U corresponding to the deviation Ev between the target velocity Vr and the velocity V of the carriage 71 which is detected by the signal processing circuit 95, up to the predetermined time (t=Ts) in the process in which the carriage 71 is moving to the target stop position Xe.

Further, the motor controller 40 executes the position control processing (steps S160 to S170) of inputting, to the motor driving circuit 85, the voltage command value U corresponding to the deviation Ex between the target position Xr and the position X of the carriage 71 which is detected by the signal processing circuit 95 since the predetermined time (t=Ts), and in accordance with the predetermined transfer function including the integral element. The predetermined transfer function including the integral element described herein corresponds to a transfer function G defined by the PI controller: $G(s)=(Kp+Ki/s)$, wherein "Kp" represents the proportional action coefficient, "Ki" represents the integration gain, and "s" represents the Laplace operator.

The motor controller 40 further sets, based on the position X and the velocity V of the carriage 71, the target position trajectory of the carriage 71 up to the target stop position Xe when switching from the velocity control to the position control (step S150). In addition to this, the motor controller 40 executes the set processing for setting the initial value Ui of the integral element based on the initial target velocity Vr0 and the initial target acceleration Ar0 of the carriage 71 in accordance with the target position trajectory (steps S310 to S350). Thus, according to the embodiment, in the case of stopping the carriage 71 at the target stop position Xe by performing the switching from the velocity control to the position control, the initial value Ui in the position control can be set appropriately.

In particular, according to the embodiment, the initial value Ui in accordance with the relational expression $Ui=K1\times Vr0+K2\times Ar0$ is set in the integrator 445 of the position controller 40, while considering the back electromotive force of the motor and the kinetic system of the carriage. Thus, according to the embodiment, the position control started while the deceleration is performed can be executed appropriately, thereby making it possible to stop the carriage 71 at the target stop position highly precisely, as depicted in FIGS. 9A to 9C.

As depicted in FIGS. 10A to 10C, in the case that, when the switching is performed from the velocity control to the position control, the voltage command value at the time at which the velocity control has been ended is set as the initial value Ui, the deceleration cannot be performed quickly, and thus the overshoot in which the carriage 71 passes through the target stop position Xe occurs easily. According to the embodiment, however, the rate of occurrence of the overshoot and the amount of overshoot can be significantly suppressed, as compared with such a technology as described above.

The suppression of the overshoot contributes to suppress any collision of the carriage 71 against a wall located at an end in the conveyance path. Alternatively, it is not necessary to make the casing of the image forming system 1 to be great for the purpose of suppressing such a collision. In addition, regarding the reciprocating movement of the carriage 71, it is also possible to suppress the degradation of the print quality which would be otherwise caused by any incorrect turning point in the reciprocating movement.

According to the embodiment, since the coefficients K1 and K2 are updated based on samples of the velocity V, the acceleration A and the voltage command value U during the conveyance, it is possible to stop the carriage 71 at the target stop position Xe highly precisely while suppressing the influence brought about the change in the true values of the coefficients K1 and K2 due to, for example, aging (change with passage of time). In addition, the occasion for updating the coefficients K1 and K2 is rather limited to such a situation when the conveyance error $\delta$ is great, and thus it is possible to update the coefficients K1 and K2 efficiently and as necessary.

In particular, according to the embodiment, since the coefficients K1 and K2 are updated based on the samples of the velocity V, the acceleration A and the voltage command value U in the constant velocity segment and the deceleration segment, and since the acceleration A in the constant velocity segment is basically 0 (zero), it is possible to easily calculate the coefficients K1 and K2.

The technique of the present disclosure as explained above is not limited to the embodiment, and may take a various kinds of aspects.

For example, the coefficients K1 and K2 may be updated based on samples of the velocity V, the acceleration A and the voltage command value U in the constant velocity segment and the acceleration segment. Further, it is allowable that the coefficients K1 and K2 are respectively fixed values. Alternatively, it is allowable that one of the coefficients K1 and K2 is a fixed value, and the other of the coefficients K1 and K2 is a value which is to be calculated and updated. In such a case, the data obtainment processing section 470 may be configured to obtain only one of the first and second obtained values. The data obtainment processing section 470 may also be configured to obtain, with respect to a plurality of times which are three or more times, the velocity V and the acceleration A of the carriage 71 and the voltage command value U corresponding to each of the three or more times. In this case, the data obtainment processing section 470 may be configured to calculate and update the coefficients K1 and K2 by using the regression analysis method.

In the error determination processing, the magnitude of the conveyance error is determined based on the error between the actual stop position X and the target stop position Xe of the carriage 71. It is allowable, however, that the magnitude of the conveyance error may be determined based on, for example, whether or not the actual velocity of the carriage 71 at a time at which the carriage 71 reaches the target stop position is not less than a predetermined value.

Other than these described above, the signal processing circuit 95 may be configured to detect only the position X of the carriage 71 based on the encoder signal, and to specify the velocity V and the acceleration A based on the change of the position X due to the aging. The methods for detecting and specifying the position X, the velocity V and the acceleration A of the carriage 71 are not limited to the samples of the embodiment as described above.

The technique of the present disclosure is not being limited only to the application to the image forming system, and the technique of the present disclosure is applicable to a various kinds of systems configured to control the movement of an object by performing the switching from the velocity control to the position control such that the object is allowed to stop at the target stop position.

The function provided on a certain constitutive element (part, component, etc.) in the embodiment may be provided on a plurality of constitutive elements in a divided manner; a function provided on a plurality of constitutive elements may be integrated in a certain constitutive element. A part of the configuration of the embodiment may be omitted. Any and every aspect, encompassed by the technical idea specified from the wordings described in the claims, is an embodiment of the present disclosure.

The CR motor 81 corresponds to an example of the motor; the carriage conveyor 70 corresponds to an example of the moving apparatus; the linear encoder 91 and the signal processing circuit 95 correspond to an example of the detector; the motor driving circuit 85 corresponds to an example of the driving circuit; and the motor controller 40 corresponds to an example of the controller.

What is claimed is:

1. A control system comprising:

a motor;

a moving apparatus driven by the motor and configured to move an object;

a detector configured to detect a parameter from which a position, a velocity and an acceleration of the object are specifiable;

a driving circuit configured to input a voltage corresponding to a voltage command value to the motor; and a controller configured to execute:

inputting, to the driving circuit, a first voltage command value corresponding to a deviation between a target velocity and the velocity of the object which is specified from the parameter detected by the detector, until a predetermined time during a process in which the object is moving to a target stop position;

after the predetermined time, switching from the inputting the first voltage command value to the driving circuit to inputting a second voltage command value to the driving circuit, the second voltage command value corresponding to a deviation between a target position and the position of the object which is specified from the parameter detected by the detector, and the second voltage command value being in accordance with a transfer function including an integral element;

setting a target position trajectory of the object up to the target stop position based on the parameter detected by the detector;

setting an initial value of the integral element based on an initial target velocity and an initial target acceleration of the object in accordance with the target position trajectory; and inputting the second voltage command value to the driving circuit, wherein the predetermined time is a time after a deceleration of the object to stop the object at the target stop position has been started.

2. The control system according to claim 1, wherein the controller is configured to set the initial value of the integral element to "Ui" in accordance with the following relational expression, $$Ui=K1\times Vr0+K2\times Ar0$$

wherein "Vr0" and "Ar0" represent the initial target velocity and the initial target acceleration, respectively, of the object in accordance with the target position trajectory, and "K1" and "K2" represents coefficients.

3. The control system according to claim 2, wherein the controller is configured to further execute calculating or updating at least one of the coefficient K1 and the coefficient K2 in accordance with the following relational expression:

$$U=K1\times V+K2\times A$$

wherein in the relational expression, "V" and "A" represent the velocity and the acceleration, respectively, of the object which are specified from the parameter detected by the detector, and U represents the voltage command value input to the driving circuit at a corresponding time corresponding to the detection of the parameter by the detector.

4. The control system according to claim 3, wherein the controller is configured to execute the calculating or updating at least one of the coefficients K1 and K2, under a condition that a phenomenon occurs in which an error between the target stop position and an actual stop position of the object is greater than a reference; and the controller is configured to execute the calculating or updating at least one of the coefficients K1 and K2, based on the velocity V and the acceleration A in a case that the controller executes the inputting the first voltage command value to the driving circuit after occurrence of the phenomenon, and based on the voltage command value U at a corresponding time corresponding to a time after the occurrence of the phenomenon.

5. The control system according to claim 3, wherein the controller is configured to execute the calculation or updating the coefficients K1 and K2 based on the velocity V and the acceleration A at two or more time points in a case that the controller executes the inputting the first voltage command value to the driving circuit, and based on the voltage command value U at each of corresponding time points corresponding to the two or more time points, respectively.

6. The control system according to claim 5, wherein the process in which the object is moving to the target stop position includes an acceleration process in which the object accelerates, a constant velocity process in which the object moves at a constant velocity, and a deceleration process in which the object decelerates; and the two or more time points includes at least one time point corresponding to the constant velocity process and at least one time point corresponding to one of the acceleration process and the deceleration process.

7. An image forming system comprising:

a recording head;

a carriage on which the recording head is mounted;

a motor;

a conveyor driven by the motor and configured to convey the carriage;

a detector configured to detect a parameter from which a position, a velocity and an acceleration of the carriage are specifiable;

a driving circuit configured to input a voltage corresponding to a voltage command value to the motor; and a controller configured to execute:

inputting, to the driving circuit, a first voltage command value corresponding to a deviation between a target velocity and the velocity of the carriage which is specified from the parameter detected by the detector, until a predetermined time during a process in which the carriage is moving to a target stop position;

after the predetermined time, switching from the inputting the first voltage command value to the driving circuit to the inputting a second voltage command value to the driving circuit, the second voltage command value corresponding to a deviation between a target position and the position of the carriage which is specified from the parameter detected by the detector, and the second voltage command value being in accordance with a transfer function including an integral element;

setting a target position trajectory of the carriage up to the target stop position based on the parameter detected by the detector;

setting an initial value of the integral element based on an initial target velocity and an initial target acceleration of the carriage in accordance with the target position trajectory; and inputting the second voltage command value to the driving circuit, wherein the predetermined time is a time after a deceleration of the carriage to stop the carriage at the target stop position has been started.

* * * * *